United States Patent [19]

Swaney

[11] 4,335,831

[45] Jun. 22, 1982

[54] INSULATED CRYOGENIC LIQUID CONTAINER

[75] Inventor: William A. Swaney, Toledo, Ohio

[73] Assignee: Owens-Corning Fiberglas Corporation, Toledo, Ohio

[21] Appl. No.: 869,544

[22] Filed: Jan. 16, 1978

[51] Int. Cl.[3] ..... B65D 87/24

[52] U.S. Cl. ..... 220/901; 220/430; 220/436

[58] Field of Search ..... 220/430, 421, 432, 434, 220/435, 437, 901, 470, 436, 452

[56] References Cited

U.S. PATENT DOCUMENTS

| | | | |
|---|---|---|---|
| 3,150,793 | 9/1964 | Messer | 220/901 X |
| 3,302,358 | 2/1967 | Jackson | 220/421 X |
| 3,384,044 | 5/1968 | Witt | 220/436 X |
| 3,547,302 | 12/1970 | Jackson | 220/901 X |

*Primary Examiner*—Steven M. Pollard

*Attorney, Agent, or Firm*—Ronald C. Hudgens; Philip R. Cloutier; Paul J. Rose

[57] ABSTRACT

Composite insulating panels each having a generally rectangular casing and insulating material in the casing are mounted by mechanical fastening means in a covering layer over an inner surface of a supporting enclosure. A cross-shaped joint cover member is installed between four adjacent corner portions of each group of four rectangularly arranged composite panels. A straight joint cover member is installed between each pair of adjacent composite panels, a pair of opposite end portions thereof being joined respectively to a pair of the cross-shaped joint cover members. Each of four leg portions of each cross-shaped joint cover member has a generally U-shaped cross section open toward the inner surface of the supporting enclosure. Each straight joint cover member has a generally U-shaped cross-section open toward the inner surface of the supporting enclosure. The casing of each composite panel includes a front panel portion which is flat except for raised, outwardly convex, curved edge portions blending into the sides of the casing.

8 Claims, 14 Drawing Figures

INSULATED CRYOGENIC LIQUID CONTAINER

This invention relates generally to containing means for transporting or storing cryogenic liquids such as liquefied natural gas, and more particularly to an insulated membrane tank.

An object of the invention is to provide an improved membrane tank for cryogenic liquids such as liquefied natural gas.

Another object is to provide an improved insulated cryogenic liquid container including improved composite insulating panels mounted on an inner surface of a supporting enclosure and improved joint cover means between the mounted panels.

Other objects and advantages will become apparent when the following specification is considered along with the accompanying drawings in which.

While the insulated membrane tank of cryogenic liquid container of the invention may be installed inside any enclosure for storage or transport of cryogenic liquids, it is particularly useful in cargo ships for transporting liquefied natural gas and will be described with respect to such cargo ships. The present invention is an improvement over the insulated cryogenic liquid container disclosed in the U.S. Pat. No. 4,050,608, issued Sept. 27, 1977.

Figure 1:
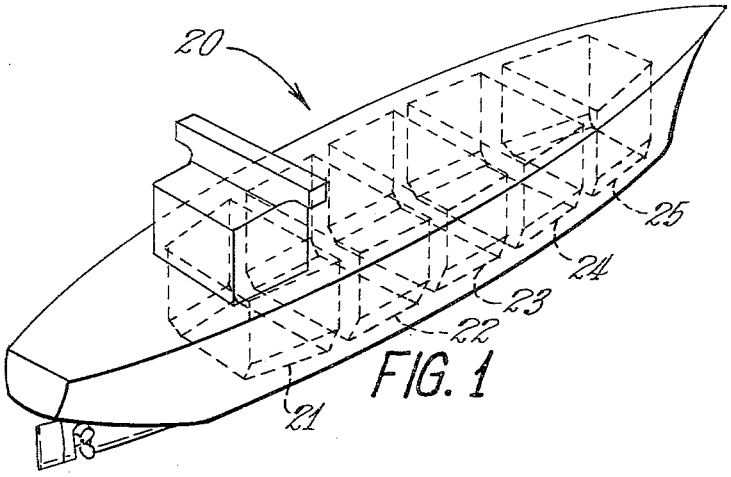
FIG. 1 is a perspective view of a cargo ship having five holds indicated by broken lines and having insulated membrane tanks or cryogenic liquid containers constructed in accordance with the invention.
Figure 2:
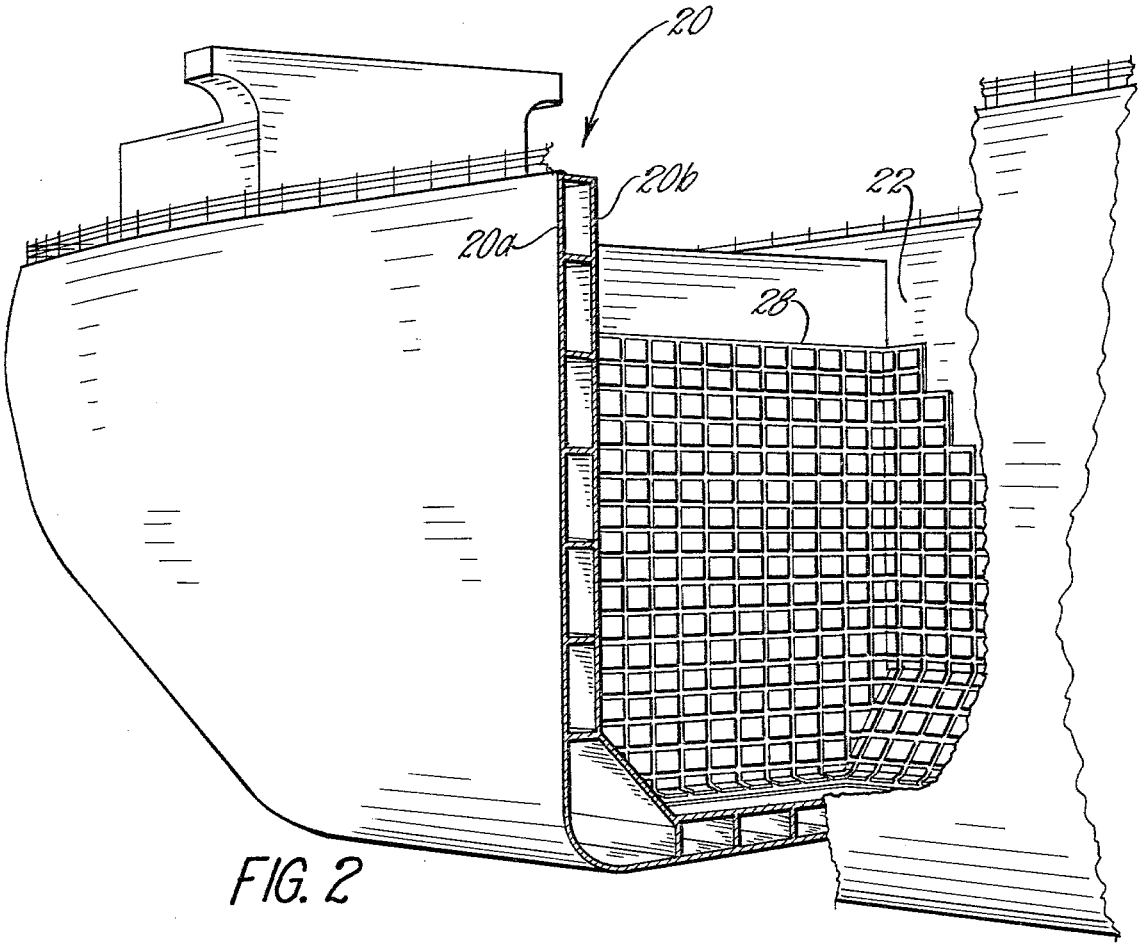
FIG. 2 is an enlarged, fragmentary, somewhat schematic, perspective view, with portions broken away, of the cargo ship of FIG. 1, showing one of the holds with a portion of the insulated membrane tank of the invention installed therein.

With reference to the drawings, a cargo ship 20 is shown somewhat schematically in FIG. 1. The ship 20 has five cargo holds 21, 22, 23, 24 and 25 indicated by broken lines. The hold 22 is shown in FIG. 2 with an insulated membrane tank or container 28 constructed in accordance with the invention partially installed therein. The ship 20 includes an outer hull **20*a* and an inner hull 20*b*, the insulated membrane tank 28 of the invention being applied to the inside of the inner hull 20*b* in each of the cargo holds 21–25** and to the transverse bulkheads dividing the cargo space into cargo holds.

Figure 3:
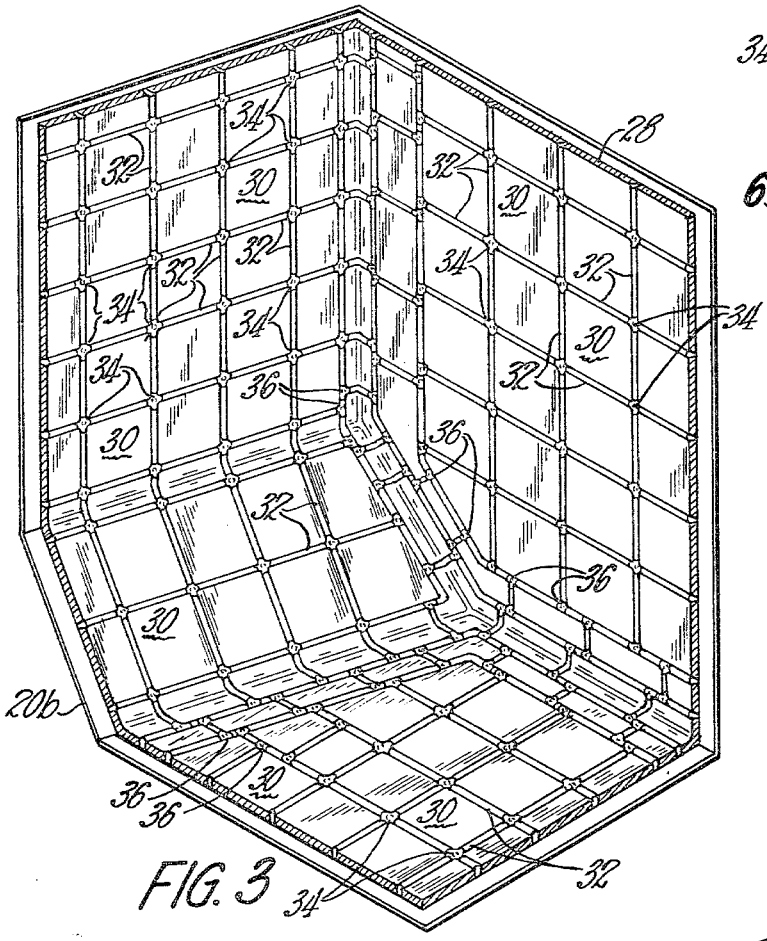
FIG. 3 is a fragmentary perspective view of one of the holds of the ship of FIG. 1, the hold having a trapezoidal bottom, showing a portion of the insulated membrane tank of the invention installed therein.

FIG. 3 is a fragmentary view of one of the cargo holds such as hold 21, 24, or 25 having a trapezoidally shaped bottom wall and having a schematically shown insulated membrane tank 28 constructed in accordance with the invention installed therein. The membrane tank or cryogenic liquid container 28 includes a plurality of composite insulating panels 30, a plurality of straight joint cover members 32, a plurality of cross-shaped joint cover members 34, and a plurality of T-shaped joint cover members 36.

Figure 4:
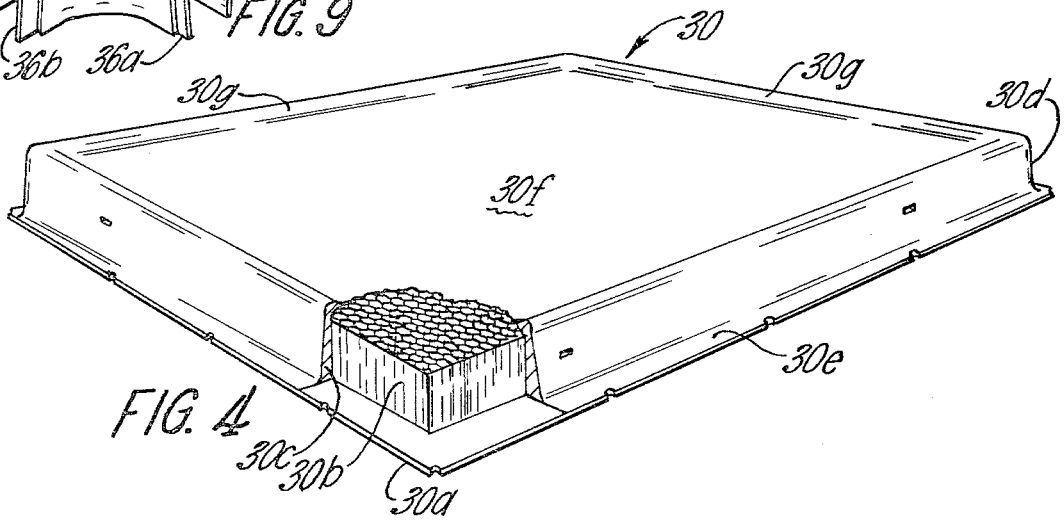
FIG. 4 is a perspective view, with portions broken away, of one of the composite insulating panels of the insulated membrane tank of the invention.

FIG. 4 shows one of the composite insulating panels 30. The panel 30 includes a rectangular backing plate **30*a* formed of glass fiber reinforced resin and provided with a pebble-textured rear or outer surface, a honeycomb reinforced foamed resin core 30*b*, fibrous glass insulation 30*c* around the front edges and sides of the core 30*b*, and a front casing 30*d* formed of glass fiber reinforced resin and having sides tapering outwardly from front to rear to a rear flange 30*e* secured to the backing plate 30*a*. A front panel portion 30*f* of the casing 30*d* is flat except for raised, outwardly convex, curved edge portions 30*g* blending into the sides of the casing and forms part of the membrane tank or cryogenic primary barrier in an installed insulated membrane tank 28**.

Figure 5:
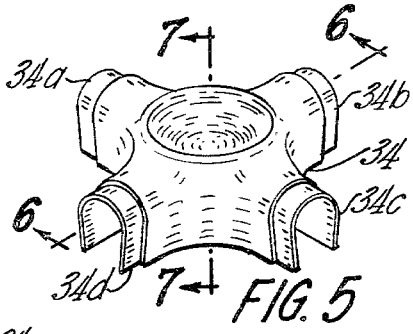
FIG. 5 is a perspective view of one of the cross-shaped joint cover members of the insulated membrane tank of the invention.
Figure 6:
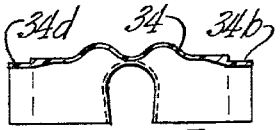
FIG. 6 is a cross-sectional view of the joint cover member of FIG. 5, taken in the direction of arrows 6—6.
Figure 7:
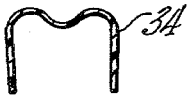
FIG. 7 is a cross-sectional view taken along the line 7—7 of FIG. 5.

FIGS. 5–7 show one of the cross-shaped joint cover members 34 each of which is adhesively secured between four adjacent corner portions of a group of four rectangularly arranged composite panels 30 in an installed membrane tank 28. Each joint cover member 34 is formed of glass fiber reinforced resin and has four leg portions **34*a*, 34*b*, 34*c*, and 34*d* of generally U-shaped cross section opening toward the hull 20*b*** or transverse bulkhead when the joint cover member is installed.

Figure 8:
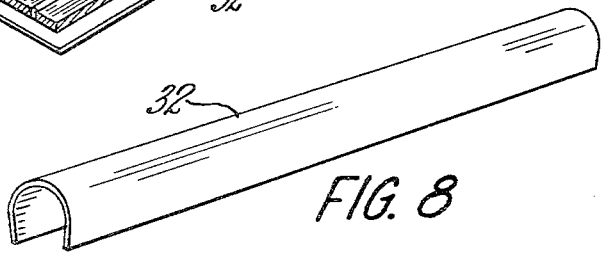
FIG. 8 is a perspective view of one of the straight joint cover members of the insulated membrane tank of the invention.

One of the straight joint cover members 32 is shown in FIG. 8. Each joint cover member 32 is formed of glass fiber reinforced resin and has a generally U-shaped cross section opening toward the hull **20*b*** or the transverse bulkhead when installed.

Figure 9:
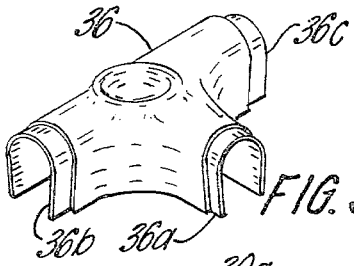
FIG. 9 is a perspective view of one of the T-shaped joint cover members of the insulated membrane tank of the invention.

FIG. 9 shows one of the T-shaped joint cover members 36. Each member 36 is formed of glass fiber reinforced resin and has three leg portions **36*a*, 36*b*, and 36*c* of generally U-shaped cross section. The T-shaped joint cover members 36 are used in transition zones from one plane of a hold to another, the leg portion 36*a* being adhesively secured between corner portions of two adjacent composite panels 30 and the leg portions 36*b* and 36*c* being adhesively secured on one side to a side of a third composite panel 30** and on the other side respectively to the corner portions of the two composite panels.

Figure 10:
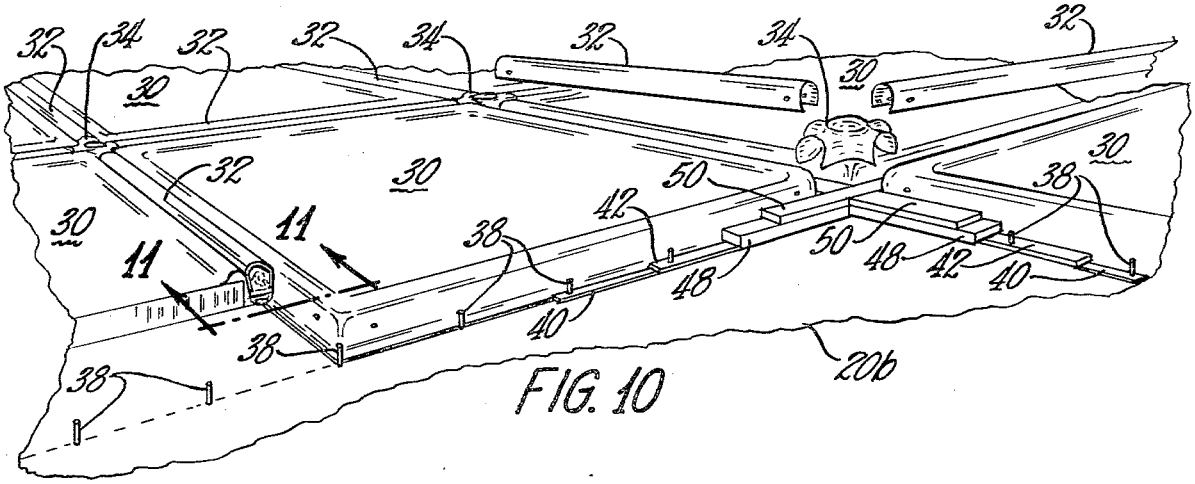
FIG. 10 is a fragmentary, partially exploded perspective view, partly in section, of the insulated membrane tank of the invention.
Figure 11:
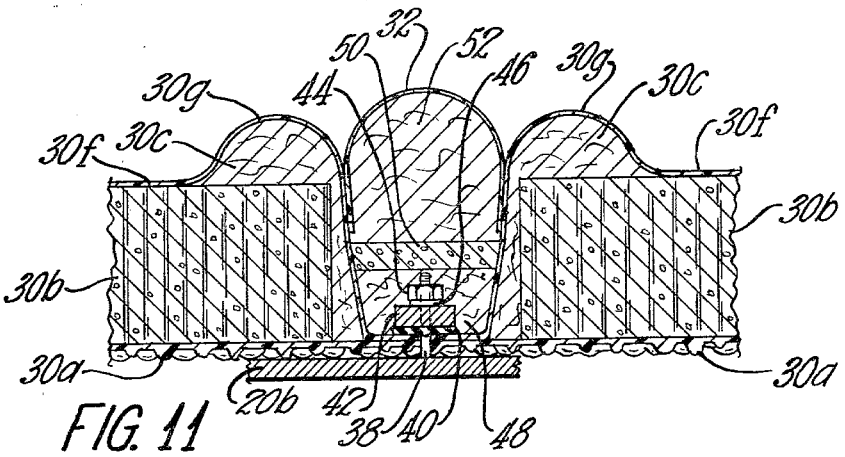
FIG. 11 is a fragmentary sectional view taken in the direction of arrows 11—11 of FIG. 10.

FIGS. 10 and 11 show details of the installation. Studs 38 are welded to the inner hull **20*b* or to the transverse bulkhead in regularly spaced parallel rows extending in each of two cross directions and defining mounting areas for the composite panels 30. The panels 30 are mounted in position. Rubber-like sealing strips 40 apertured to receive the studs 38 are placed over the rear flange 30***e* of each pair of adjacent panels 30. Steel clamping strips 42 are tightened in position over the sealing strips 40 by nuts 44 applied respectively to the studs 38 and provided with lock washers 46. Fibrous glass insulation strips 48 and foamed resin blocks 50 are installed over the clamping strips 42. The cross-shape joint cover members 34, and T-shaped joint cover members 36 where required, each containing fibrous glass insulation, are adhesively secured in place. Lastly, the straight joint cover members 32, each containing fibrous glass insulation strips 52, are adhesively secured in place.

Figure 12:
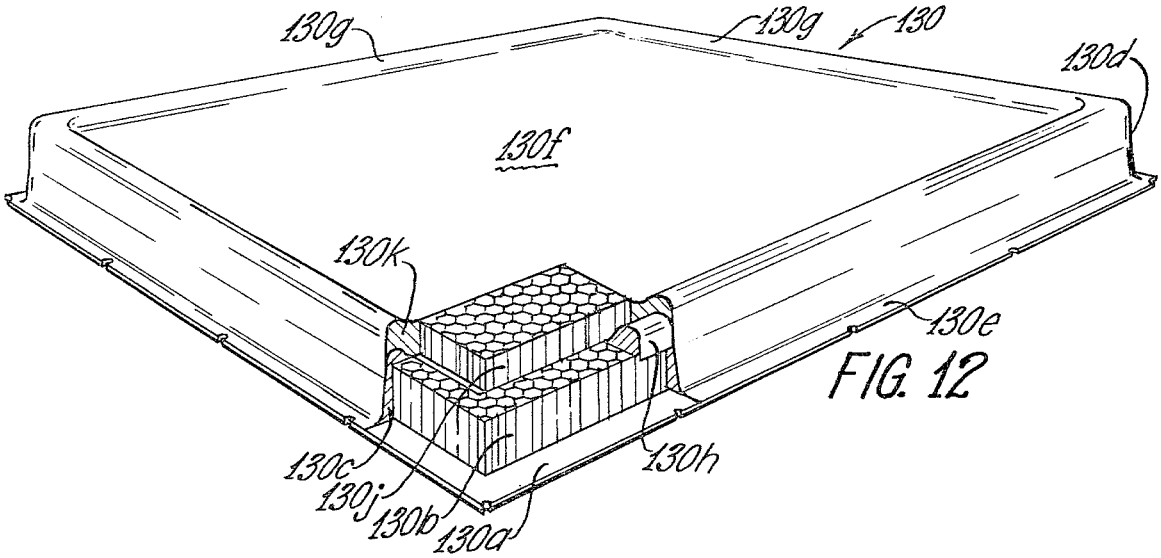
FIG. 12 is a perspective view similar to FIG. 4, with portions broken away, showing one of the composite insulating panels of an alternative embodiment of the invention.
Figure 13:
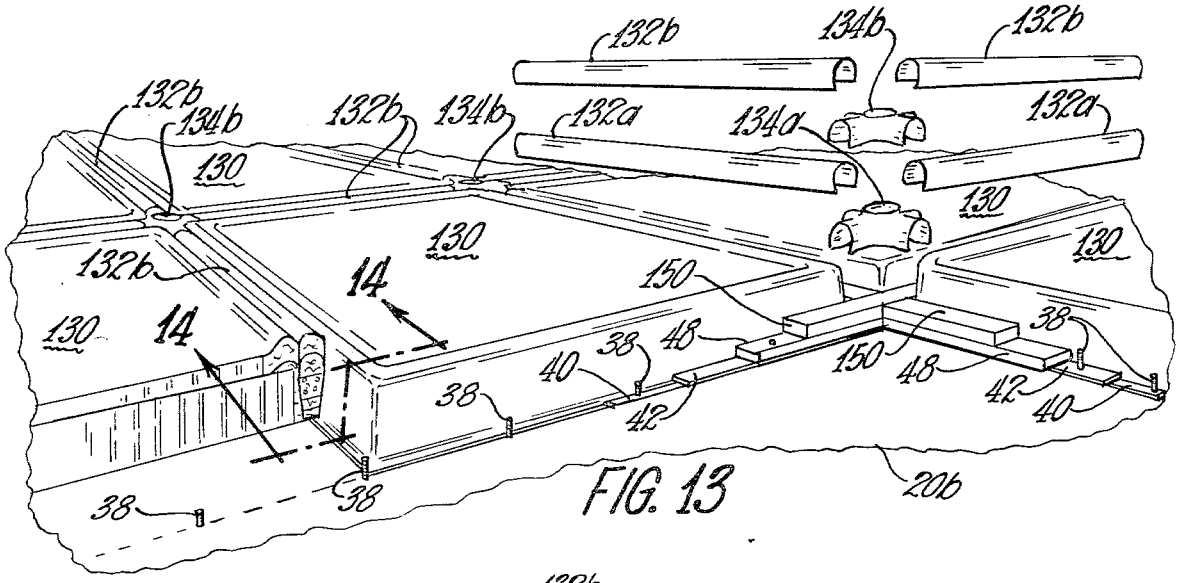
FIG. 13 is a fragmentary, partially exploded perspective view similar to FIG. 10, but showing the alternative embodiment of the invention.
Figure 14:
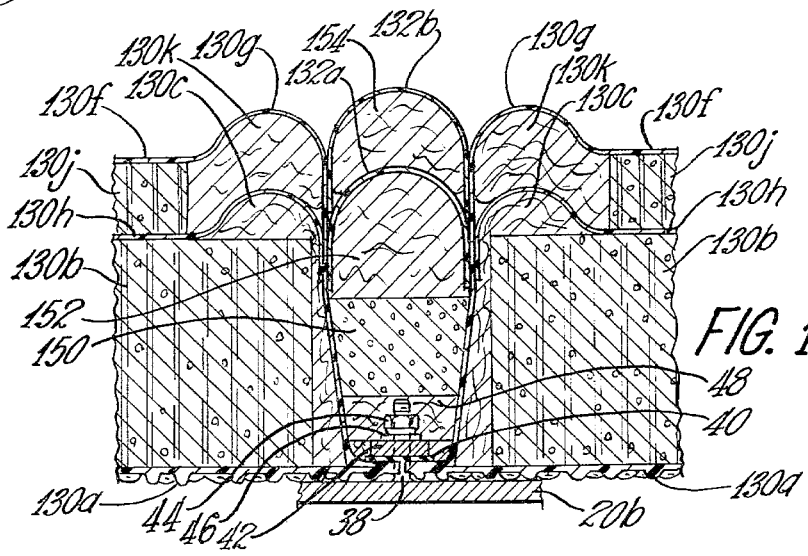
FIG. 14 is a fragmentary sectional view taken in the direction of arrows 14—14 of FIG. 13.

FIGS. 12, 13, and 14 are similar respectively to FIGS. 4, 10, and 11 and illustrate an alternative embodiment of the invention wherein a secondary insulated barrier for cryogenic liquid is provided in addition to the primary barrier. In this embodiment, double compartment composite insulating panels 130 and two layers of cross-shaped joint cover members and straight joint cover members are provided.

Each composite panel 130 includes a rectangular backing plate 130*a* of glass fiber reinforced resin, a rear core 130*b* of honeycomb reinforced foamed resin, fibrous glass insulation 130*c* around the front edges and sides of the core 130*b*, and a front casing 130*d* of glass fiber reinforced resin. The casing 130*d* has a rear flange 130*e* adhesively secured to the backing plate 130*a*. A front panel portion 130*f* of the casing is flat except for raised, outwardly convex, curved edge portions 130*g* blending into the sides of the casing and forms part of the primary barrier in an installed membrane tank 28. An interior panel 130*h* of glass fiber reinforced resin is adhesively sealed to the sides of the casing 130*d* and divides it into a rear compartment for the core 130*b* and a front compartment for a front core 130*j* of honeycomb reinforced foamed resin having fibrous glass insulation 130*k* around the edges thereof. The interior panel 130*h* has raised, outwardly convex curved edge portions similar to edge portions 130*g* of the front panel portion 130*f* and terminating in straight extreme edge portions in sealed contact with the sides of the casing 130*d*. The interior panel 130*h* forms part of the secondary barrier in an installed membrane tank 28.

FIGS. 13 and 14 show details of the installation. Studs 38, sealing strips 40, clamping strips 42, nuts 44, lock washers 46, and fibrous glass insulation 48 are essentially the same as in the embodiment of FIGS. 10 and 11. Blocks 150 of foamed resin are provided over the insulation 48. Rear cross-shaped joint cover members 134*a*, rear straight joint cover members 132*a*, front cross-shaped joint cover members 134*b*, and front straight joint cover members 132*b* are successively installed. The members 132*a* contain fibrous glass insulation 152 and the members 132*b* contain fibrous glass insulation 154. The members 134*a* and 134*b* also contain fibrous glass insulation (not shown).

The blocks 50 and 150 and the cores 30*b*, 130*b*, and 130*j* are preferably of polyurethane foam.

There are several advantages to the U-shaped cross section of the straight joint cover members 32, 132*a* and 132*b*. These members are made slightly larger than the space between panel casings into which they must fit. When they are installed, the opposed leg portions are squeezed together slightly. In trying to regain their relative unrestrained positions, the leg portions press against the prespective panel casings and furnish bonding pressure for the adhesive. The U-shape of the members also results in an expansion-contraction joint for relieving stresses caused by expansion and contraction of the composite panels 30 or 130. Further, the curved arch portion of the U-shape provides sufficient load-bearing capacity to eliminate the need for strong bearing material to the rear thereof all the way to the hull 20*b* and to permit the use of fibrous glass insulation. In addition, the U-shape of the members compensates for any misalignment of the composite panels 30 or 130 in the direction perpendicular to the mounting surface, thereby eliminating the need for expensive levelling procedures when the mounting surface is not perfectly flat. These same advantages also apply to the cross-shaped joint cover members 34, 134*a*, and 134*b* with their U-shaped leg portions, and to the T-shaped members 36 with their U-shaped leg portions.

In the embodiment of FIGS. 4, 10, and 11, the front panel portions 30*f* of the casings, including the raised edge portions 30*g*, the cross-shaped joint cover members 34, and the straight joint cover members 32 form a primary barrier directly contacting cryogenic liquid when the membrane tank is in use. The raised edge portions 30*g* provide stress relief from expansion and contraction forces. Further, each of the composite panels 30 is securely clamped all around at the rear flange 30*e* and the foam core 30*b* thereof may be bonded to the backing plate 30*a* and to the front panel portion 30*f*, whereby contraction-expansion forces can be made to occur mainly at the raised edge portions 30*g* and relatively large panels can be used.

In the embodiment of FIGS. 12–14, the front panel portions 130*f* of the casings, including the raised edge portions 130*g*, the cross-shaped joint cover members 134*b*, and the straight joint cover members 132*b* form a primary barrier. The interior panels 130*h*, the cross-shaped joint cover members 134*a*, and the straight joint cover members 132*a* form a secondary barrier. The raised edge portions 130*g* and the correspondingly shaped edge portions of the interior panels 130*h* provide stress relief from expansion and contraction forces. The rear core 130*b* may be bonded to the backing plate 130*a* and to the interior panel 130*h*. The front core 130*j* may be bonded to the interior panel 130*h* and to the front panel portion 130*f*.

Various modifications may be made in the structure shown an described without departure from the spirit and scope of the invention as set forth in the appended claims.

I claim:

1. An insulated cryogenic liquid container comprising a supporting enclosure having a generally planar inner surface, a pair of composite insulating panels each including a generally rectangular glass fiber reinforced resin casing having a front panel portion and four sidewall portions and insulating material in the casing, the panels being mounted adjacent each other on the inner surface with space between the casings thereof, and a straight glass fiber reinforced resin joint cover member disposed in the space between the casings, the joint cover member having a generally U-shaped cross section opening toward the inner surface with a pair of opposite leg portions adhesively secured in overlapping relationship respectively to adjacent sidewall portions of the casings, the front panel portions of the casings and the joint cover member forming a portion of a primary barrier for directly contacting cryogenic liquid when the container is in use.

2. An insulated cryogenic liquid container as claimed in claim 1 wherein the front panel portion of each casing is generally flat with raised, outwardly convex, curved edge portions blending respectively into the sidewall portions.

3. An insulated cryogenic liquid container comprising a supporting enclosure having a generally planar inner surface, a pair of composite insulating panels each including a casing having a front panel portion, an interior panel sealed to and dividing the casing into front and rear compartments, and insulating material in each of the compartments, the composite panels being mounted adjacent each other on the inner surface with space between the casings thereof, and a front straight joint cover member and a rear straight joint cover member disposed in the space between the casings, each joint cover member having a generally U-shaped cross section opening toward the inner surface and being joined on opposite sides respectively to the casings, the front panel portions of the casings and the front joint cover member forming a portion of a primary barrier for directly contacting cryogenic liquid when the container is in use, and the interior panels and the rear joint cover member forming a portion of a secondary barrier for confining any cryogenic fluid which escapes through any unforeseen defects in the primary barrier.

4. An insulated cryogenic liquid container as claimed in claim 3 wherein the casing of each of the composite panels has a plurality of sides, the front panel portion of the casing is generally flat with raised, outwardly convex, curved edge portions blending respectively into the sides, and the interior panel is generally flat with raised, curved edge portions generally corresponding with those of the front panel portion and terminating in straight extreme edge portions respectively parallel and sealed to the sides of the casing.

5. An insulated cryogenic liquid container comprising a supporting enclosure having a generally planar inner surface, a plurality of generally rectangular composite insulating panels each including a glass fiber reinforced resin casing having a front panel portion and four sidewall portions and insulating material in the casing, the panels being mounted in rows in a covering layer over the planar inner surface with a cross-shaped space separating the casings of each group of four rectangularly arranged mounted composite panels, a plurality of cross-shaped glass fiber reinforced resin joint cover members disposed respectively in the cross-shaped spaces, each cross-shaped joint cover member being joined to adjacent corner portions of the respective group of four composite panels and having four leg portions of generally U-shaped cross section opening toward the inner surface, and a plurality of straight glass fiber reinforced resin joint cover members disposed respectively in the spaces between the casings of each pair of adjacent composite panels, each straight joint cover member having a generally U-shaped cross section opening toward the inner surface with a pair of opposite leg portions adhesively secured in overlapping relationship respectively to adjacent sidewall portions of the casings of the respective pair of adjacent composite panels, and each straight joint cover member being joined at opposite ends respectively to a pair of the cross-shaped joint cover members.

6. An insulated cryogenic liquid container as claimed in claim 5 wherein the front panel portion of each casing is generally flat with raised, outwardly convex, curved edge portions blending respectively into the sidewall portions.

7. An insulated cryogenic liquid container as claimed in claim 5 wherein each of the composite insulating panels has a front panel portion and an interior panel sealed to and dividing the casing into front and rear compartments, each of the compartments has insulating material therein, the cross-shaped joint cover members include both front and rear members disposed respectively in the cross-shaped spaces, and the straight joint cover members include both front and rear members disposed respectively in the spaces between the casings of each pair of adjacent composite panels, the front panel portions, the front cross-shaped joint cover members, and the front straight joint cover members forming a portion of a primary barrier for cryogenic liquid, and the interior panels, the rear cross-shaped joint cover members, and the rear straight joint cover members forming a portion of a secondary barrier for cryogenic liquid.

8. An insulated cryogenic liquid container as claimed in claim 7 wherein the front panel portion of each casing is generally flat with raised, outwardly convex, curved edge portions blending respectively into the sidewall portions, and the interior panel of each of the composite panels is generally flat with raised, curved edge portions generally corresponding with those of the front panel portion and terminating in straight extreme edge portions respectively parallel and sealed to the sidewall portions of the casing.

* * * * *